US006000377A

United States Patent [19]

Sato et al.

[11] Patent Number: 6,000,377

[45] Date of Patent: Dec. 14, 1999

[54] APPARATUS FOR CONTROLLING A THROTTLE VALVE ELECTRONICALLY IN AN INTERNAL COMBUSTION ENGINE

[75] Inventors: Hisaaki Sato; Ikuo Mogi, both of Gunma; Masato Kumagai, Saitama; Munehiro Kudo; Keiichi Kai, both of Gunma, all of Japan

[73] Assignee: Unisia Jecs Corporation, Atsugi, Japan

[21] Appl. No.: 09/044,094

[22] Filed: Mar. 19, 1998

[30] Foreign Application Priority Data

Mar. 19, 1997 [JP] Japan ..... 9-065857

[51] Int. Cl.[6] ..... F02D 9/08

[52] U.S. Cl. ..... 123/337; 123/399; 29/890.12

[58] Field of Search ..... 123/337, 399, 123/361; 251/214, 305; 29/890.12, 890.126, 890.127

[56] References Cited

U.S. PATENT DOCUMENTS

| | | | |
|---|---|---|---|
| 4,809,659 | 3/1989 | Tamaki et al. | 123/399 |
| 5,092,296 | 3/1992 | Gunter et al. | 123/337 |
| 5,177,866 | 1/1993 | Bennett et al. | 29/890.127 |
| 5,265,572 | 11/1993 | Kadomukai et al. | 123/396 |
| 5,275,375 | 1/1994 | Semence | 251/308 |
| 5,452,697 | 9/1995 | Sasaki et al. | 123/399 |
| 5,490,487 | 2/1996 | Kato et al. | 123/399 |
| 5,687,691 | 11/1997 | Kaiser et al. | 123/337 |
| 5,718,202 | 2/1998 | Bentz et al. | 123/399 |

*Primary Examiner*—Tony M. Argenwright
*Assistant Examiner*—Arnold Castro
*Attorney, Agent, or Firm*—Foley & Lardner

[57] ABSTRACT

An apparatus for controlling a throttle valve electronically in an internal combustion engine comprises a throttle valve with a rotation axis disposed in an intake air passage of an internal combustion engine, and an actuator with two ends and a central body disposed in parallel with the rotation axis of the throttle valve and extending back part way along the length of the throttle valve, and a casing formed around the throttle valve and the actuator, but not covering the central body of the actuator to thereby allow a mold for the casing to be slidably removed in a direction at approximately a right angle to the rotation axis.

11 Claims, 9 Drawing Sheets

APPARATUS FOR CONTROLLING A THROTTLE VALVE ELECTRONICALLY IN AN INTERNAL COMBUSTION ENGINE

BACKGROUND OF THE INVENTION

1. Field of the Invention

The present invention relates to improvements to an apparatus for controlling a throttle valve electronically by an actuator such as an electronic motor in an internal combustion engine.

2. Description of the Background Art

Recently control functions for a multifunction throttle valve of an internal combustion engine include 1) an interlocking with an accelerator pedal depressed by an operator; 2) traction control so as to reduce an opening angle of the throttle valve in order to reduce slip of vehicular tire wheels during a vehicular acceleration; and 3) automatic cruise control so that a constant vehicular speed is maintained with the accelerator pedal open or not depressed. Simultaneously, a fail safe structure is included to suppress an overrun of the engine revolutions with the opening angle of the throttle valve held at a minimum position during a failure of the engine.

A Japanese Patent Application First Publication No. Showa 62-284932, published on Dec. 10, 1987, exemplifies a previously proposed throttle valve opening angle controlling apparatus in which the traction control is carried out.

In the disclosed Japanese Patent Application First Publication, a restricting plate is located between the throttle valve shaft bearing on the motor sice and a gear mechanism transmits the rotation of the motor to the throttle valve shaft. However, in the previously proposed throttle valve opening angle controlling apparatus, since the motor is not covered by a case, it is easier to induce the deterioration of each mechanical part, to permit the entry of foreign matter, and corrosion, and to reduce reliability.

It has also been necessary to have the throttle valve opening angle conttrolling apparatus disposed coaxial with the motor and the throttle valve, causing the overall length of the structure to increase, which may cause an increase in vibration.

SUMMARY OF THE INVENTION

It is, therefore, an object of the present invention to provide an apparatus for controlling a throttle valve electronically in an internal combustion engine which improves the reliability, anti-vibration characteristics, and radiation characteristics, thereby reducing the cost and the weight.

In view of the above, an apparatus for controlling a throttle valve electronically in an internal combustion engine is disclosed, comprising: a) a throttle valve with a rotation axis disposed in an intake air passage of an internal combustion engine; b) an actuator with two ends and a central body disposed in parallel with the rotation axis of the throttle valve and extending back part way along the length of the throttle valve; and c) a casing formed around the throttle valve and the actuator, but not covering the central body of the actuator to thereby allow a mold for the casing to be slidably removed in a direction at approximately a right angle to the rotation axis.

In a further aspect of the present invention, the apparatus further comprises a plurality of seal members, with a different seal member fixed between each of the supporting structures and the actuator.

In a yet further aspect of the present invention, a method is disclosed for forming a casing for an electronically controlled throttle valve, comprising the steps of: a) disposing a mold around a throttle valve that has an intake air passage with a central rotation axis, and around an actuator that is positioned adjacent to and in parallel with the throttle valve; b) forming a casing around the throttle valve and actuator with the mold; and c) removing the mold in a direction at approximately a right angle to the central rotation axis of the intake air passage.

This design prevents vibration, the entry of foreign matter, and improves reliability in the above apparatus for controlling the throttle valve electronically in an internal combustion engine.

DETAILED DESCRIPTION OF THE PREFERRED EMBODIMENTS

Figure 7A:
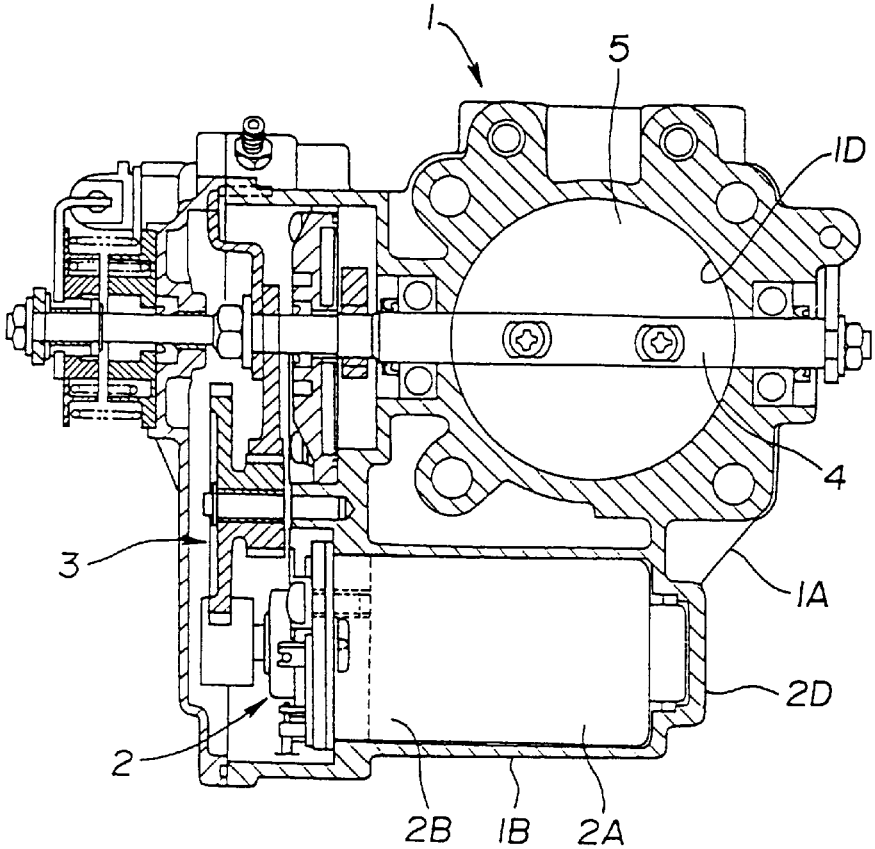
FIG. 7A is a section view of an apparatus for controlling a throttle valve electronically according to one proposal for a design.
Figure 7B:
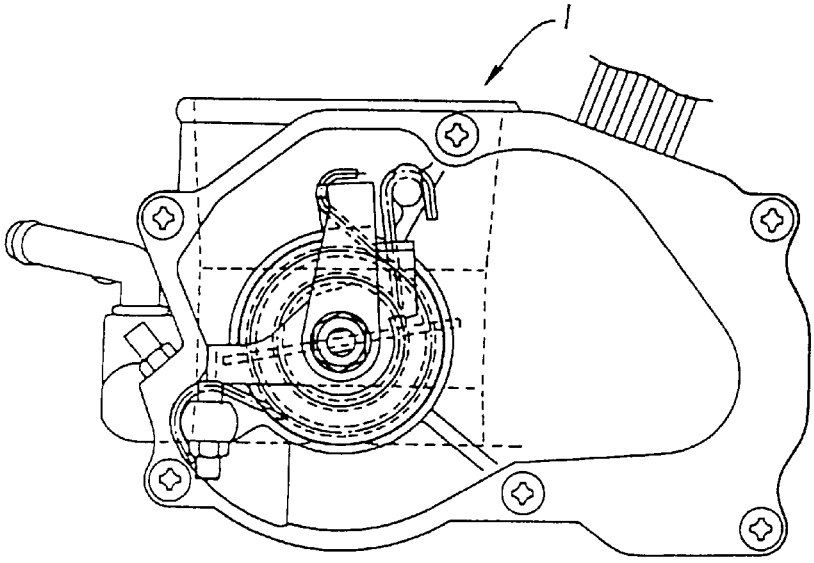
FIG. 7B is a side view of an apparatus for controlling a throttle valve electronically according to one proposal for a design.
Figure 8A:
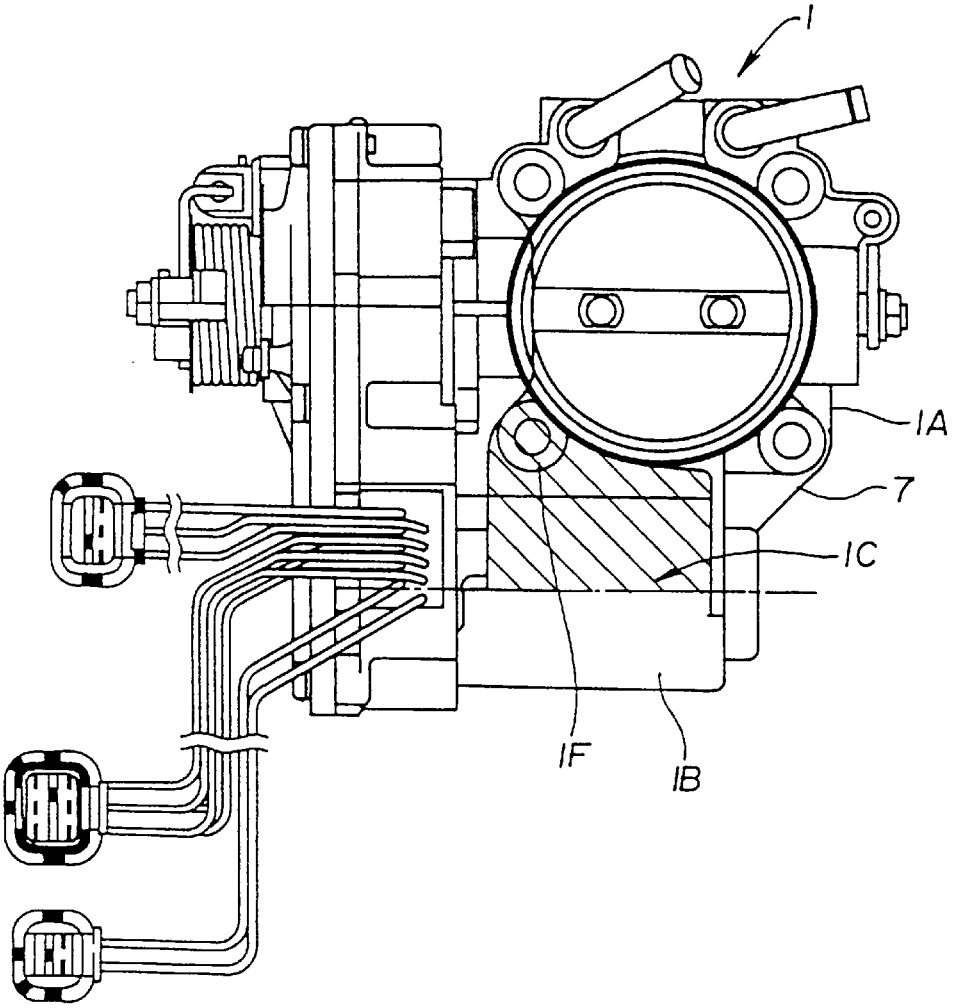
FIG. 8A is a plan view of an apparatus for controlling a throttle valve electronically according to one proposal for a design.
Figure 8B:
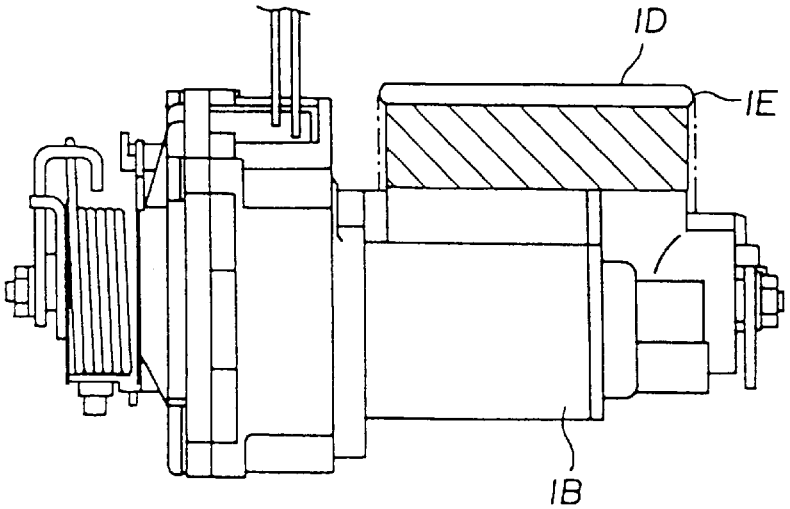
FIG. 8B is a front view of an apparatus for controlling a throttle valve electronically according to one proposal for a design.
Figure 9:
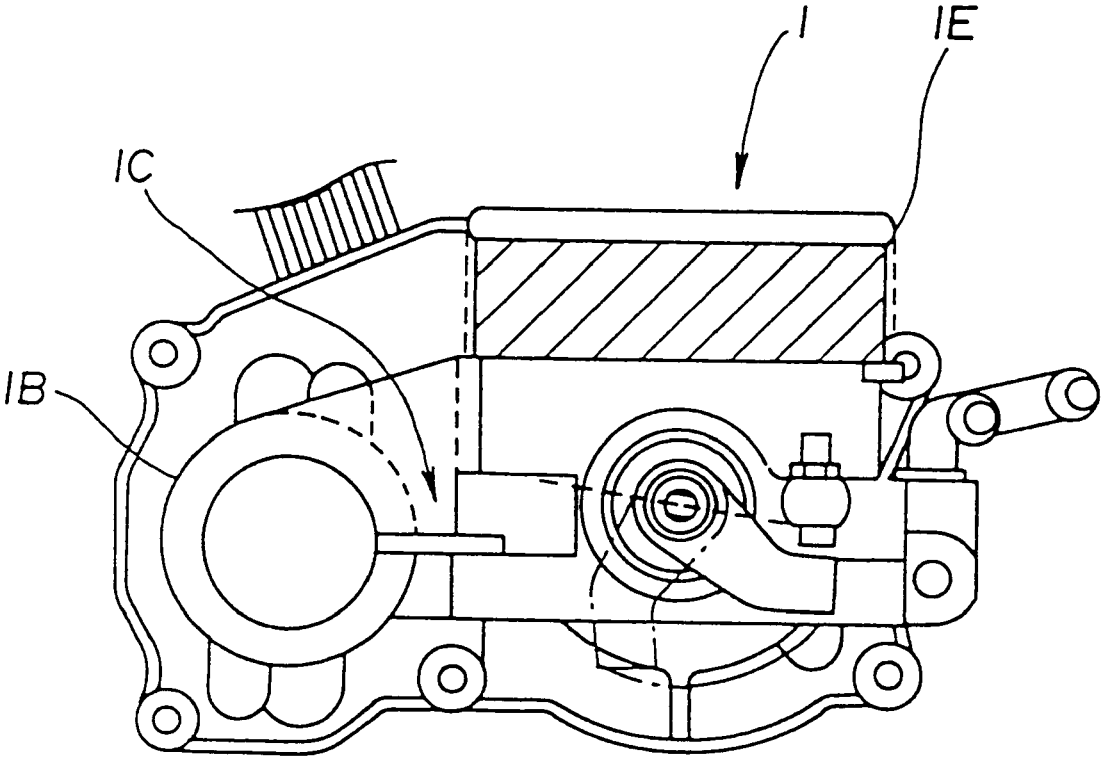
FIG. 9 is a side view of an apparatus for controlling a throttle valve electronically according to one proposal for a design.

One proposal for an apparatus design 1 that is not prior art is shown in FIGS. 7,8,9. The apparatus 1 is installed in an intake air passage of an internal combustion engine. An actuator 2, such as an electronic motor, generates driving power on the basis of a driving signal of a control unit (not shown), to open/close a throttle valve 5 through a gear wheel transfer structure 3 and a rotational rod 4. The actuator 2 can make an adjustment to the open angle of the throttle valve 5 that is apart from/separated from the accelerator operation of the driver.

However,this proposed design 1 for controlling the throttle valve 5 electronically has a cylindrical-shaped body 2A of the actuator 2 installed in parallel: with the rotational rod 4, and disposed in a body 1A of the apparatus 1 for controlling the throttle valve electronically in an internal combustion engine.

The body or casing 1A of the apparatus 1 for controlling the throttle valve electronically in the internal combustion engine is formed of aluminum or plastic, and includes an actuator-housing 1B for covering the cylindrical-shaped body 2A of the actuator 2 as shown FIG. 7A, which protrudes from a bump-shaped part 1C as shown FIGS. 8A, 9. When a mold for forming the bump-shaped part 1C is taken off, interference may occur between the mold and the actuator-housing 1B.

As a result, the mold cannot be taken off downward as shown in FIG. 8A or to the left-side as shown in FIG. 9. Rather it must be taken off upwardly as shown in FIGS. 8B, 9.

A projection 1E is positioned at one end of a cylinder bore 1D which comprises a part of an intake passage as shown in FIG. 8B, to prevent air leakage from an intake-hose. However, projection 1E cannot be made by the mold, because the mold for forming a part 1C would not be able to be taken off upwardly as shown in FIGS. 8B,9 due to this projection 1E. Therefore, the projection 1E must be machined after forming. Since the outside diameter of the cylinder bore 1D is made bigger by an amount of the projection 1E, a seating position 1F with a bolt which is fixed between an engine and the body 1A of the apparatus 1 for controlling the throttle valve electronically in the internal combustion engine also must be machined after forming.

Accordingly, this proposed design 1 for controlling the throttle valve electronically requires an increased work assembly process, reducing productivity, requiring the need for additional machine tooling, and higher cost. When the projection 1E is not made when forming the part 1C, it is easier to have air leakage out of the intake-hose, resulting in reduced engine power.

Figure 1A:
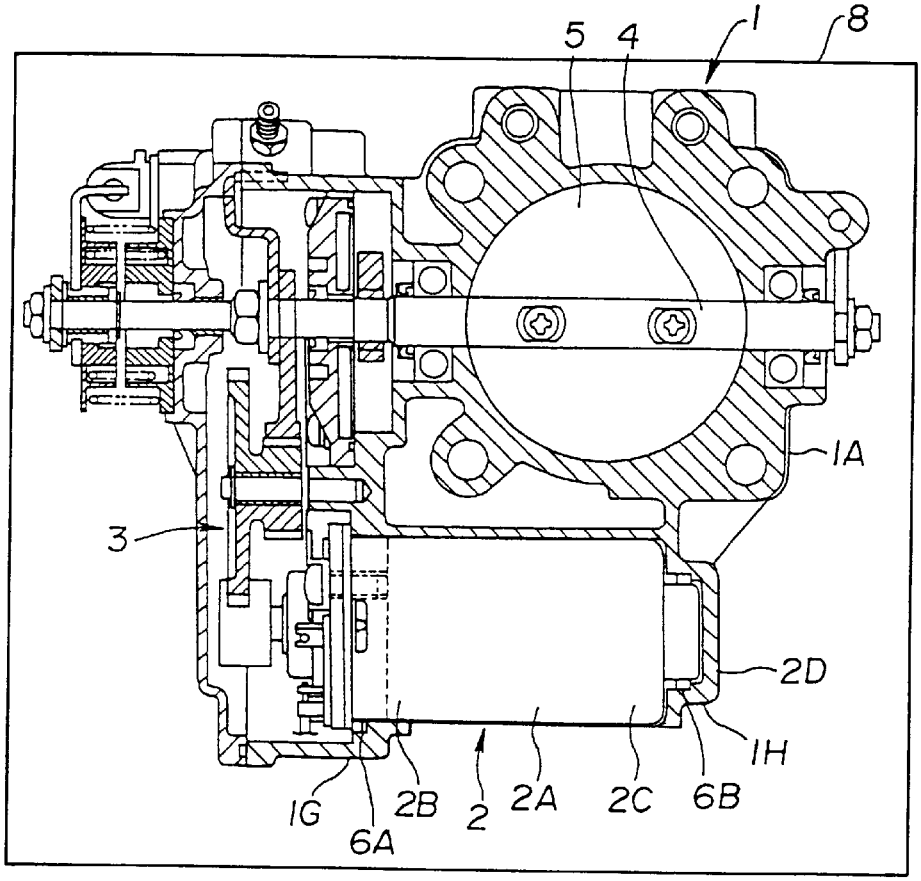
FIG. 1A is a section view of an apparatus for controlling a throttle valve electronically according to the present invention.
Figure 1B:
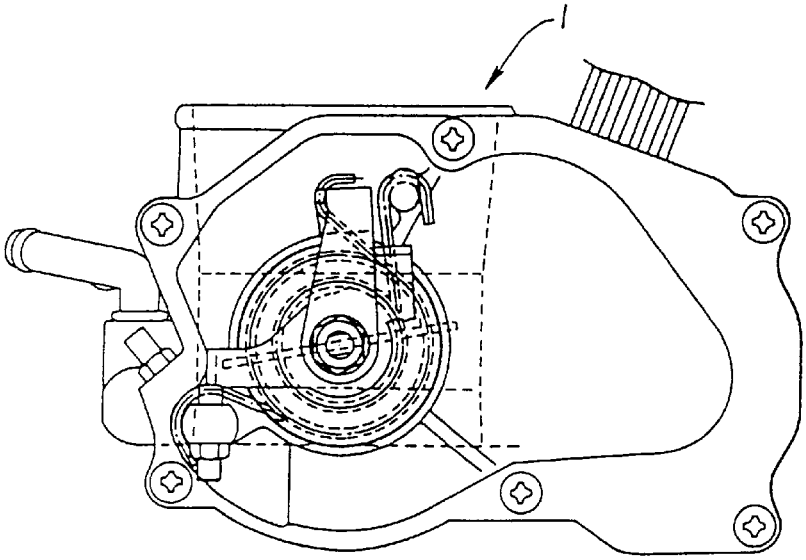
FIG. 1B is a side view of an apparatus for controlling a throttle valve electronically according to the present invention.

A more detailed description of the present invention is given below on the basis of attached figures which are provided with the same numbers for the same elements shown in FIGS. 7,8,9. The embodiment associated with the present invention is shown in FIGS. 1,2,3 which indicate a throttle valve 5 installed in an intake air passage of an internal combustion engine. The cylinder bore 1D (which comprises part of the intake air passage area) can be adjusted by the throttle valve 5, which opens/closes around a rotation rod 4 disposed on a central rotation axis for the throttle valve 5. An actuator 2 such as an electronic motor generates driving power on the basis of a driving signal of a control unit (not shown) to make an adjustment to an open angle of the throttle valve 5, which adjustment is separated from the accelerator operation of the driver.

Note that the casing 1A of the apparatus 1 for controlling the throttle valve 5 electronically in the internal combustion engine does not have an actuator-housing 1B which surrounds the body 2A of the actuator 2 in the present embodiment.

Since the present embodiment does not have the actuator housing 1B which covers the body 2A of the actuator 2 as shown in FIGS. 7A, 8B, one end 2B of the actuator 2 is fixed on a flange 1G of the casing 1A with a bolt, and the other end 2C is supported by a bracket 1H which is formed in one piece with the casing 1A. Note that a central part of the casing 2A of the actuator 2 is not covered in the present embodiment.

Figure 2A:
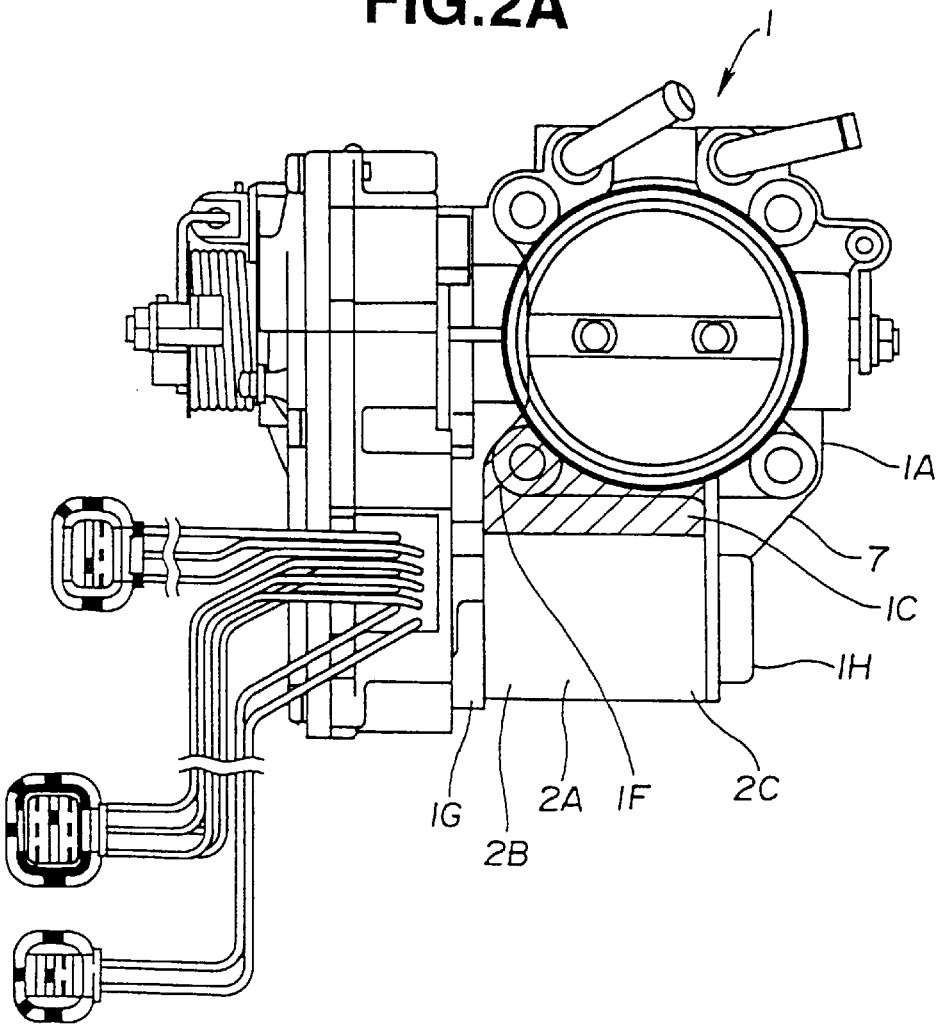
FIG. 2A is a plan view of an apparatus for controlling a throttle valve electronically according to the present invention.
Figure 2B:
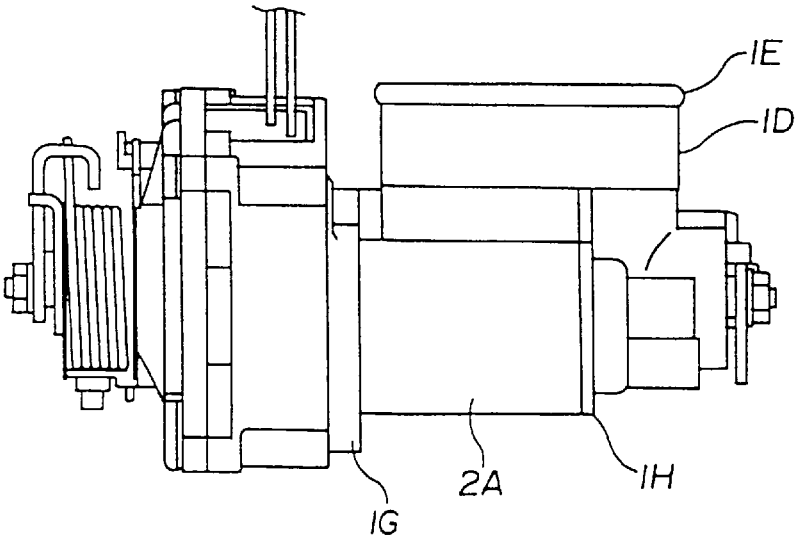
FIG. 2B is a front view of an apparatus for controlling a throttle valve electronically according to the present invention.
Figure 3:
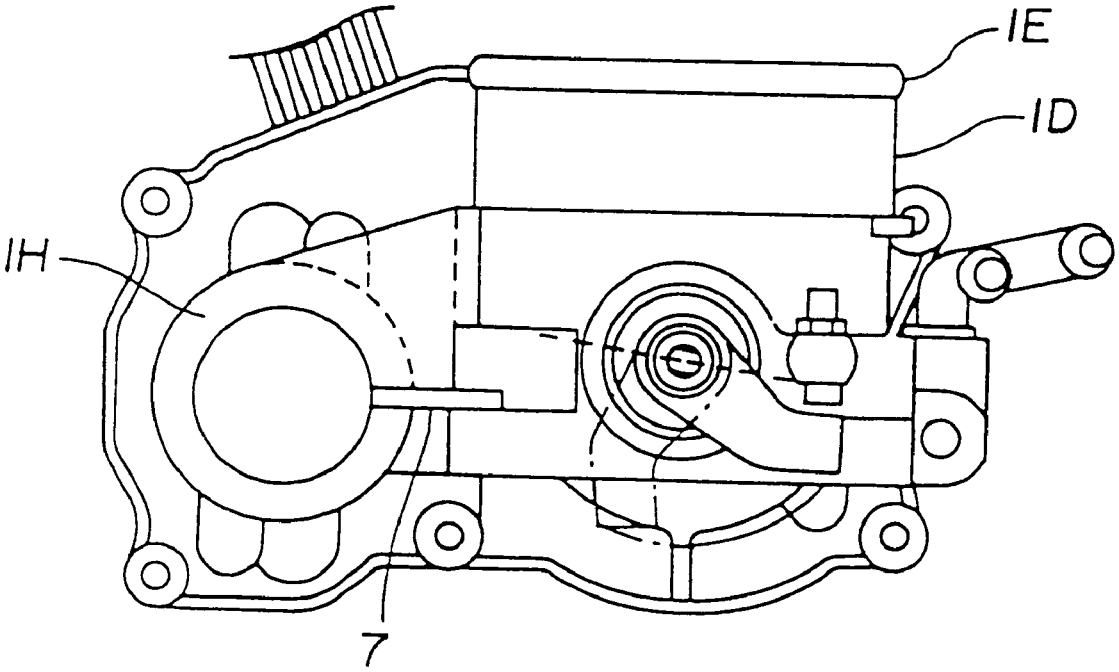
FIG. 3 is a side view of an apparatus for controlling a throttle valve electronically according to the present invention.

As a result, a mold 8 (shown diagrammatically in FIG. 1A) for forming the bump-shaped part 1C can be taken off downwardly in FIG. 2A and toward the left side in FIG. 3. Therefore, since the present embodiment of FIG. 2B does not have the actuator housing 1B and protrusions upward from a bump-shaped part 1C as shown in FIG. 9, interference does not occur between the mold for forming the bump-shaped part 1C and the actuator housing 1B, as in the design for controlling the throttle valve electronically shown in FIGS. 7–9. Note that the mold for forming the bump-shaped part 1C can be taken off downwardly in FIG. 2A and toward the left side in FIG. 3. The projection 1E is positioned at one end of a cylinder bore 1D which comprises a part of an intake passage and can be formed by the mold, thereby preventing leakage of air out of an intake-hose. Note that the seating position 1F with a bolt can be made a normal shape (a circular shape) by the mold. Since the present embodiment does not need to be machined after forming the projection 1E or the seating position 1F with a bolt, it is capable of increasing productivity and lowering cost.

Furthermore, the present embodiment has an elastic member 6A (for example, an o-ring comprising gum or silicon) which is fixed between the flange 1G and the body 2A of the actuator 2, and a member 6B fixed between bracket 1H and the body 2A of the actuator 2 in FIG. 1A. As a result, the present embodiment can prevent foreign matter particulate matter, water) from entering at the clearance between the body 2A for the actuator 2 and the flange 1G and the bracket 1H. Note that the actuator 2 and the apparatus 1 for controlling the throttle valve electronically in the internal combustion engine will thus maintain reliability. It is preferred to use standard sizes such as standard o-ring sizes for the elastic members 6A and 6B to lower cost. Alternatively, a liquefied packing can be used instead of an o-ring. Since the actuator 2 is supported on the casing 1A of the apparatus 1 for controlling the throttle valve electronically in the internal combustion engine by the elastic members 6A and 6B, the actuator 2 may be positioned easily to mesh with the gear wheel transfer structure 3. Note that a supporting part for the actuator 2 (flange 1G or bracket 1H) does not need to be machined accurately, thus reducing cost.

Also, since the design of FIGS. 7–9 includes the actuator housing 1B, which covers the actuator 2 for preventing foreign matter (particulate matter, water) from entering the actuator 2 or the apparatus 1 for controlling the throttle valve electronically in the internal combustion engine, one end 2B of the actuator 2 in that design is fixed on the flange 1G with a bolt, at one end as a supporting structure. Thus, the design does not have preferred anti-vibration characteristics.

In contrast, the actuator 2 is supported between the flange 1G and the bracket 1H in the present invention, improving anti-vibration characteristics. It is not also necessary to make the flange 1G with a heavy wall thickness, or to increase the strength of the internal structure of the actuator, which would increase the weight, the size, and the cost of the actuator. Furthermore, since the present embodiment does not cover the central part of the body 2A, it induces a heat radiation effect, and a weight reduction. Therefore, the apparatus 1 for controlling the throttle valve electronically in the internal combustion engine cannot only be maintained highly dust-resistant and waterproof, but also has improved anti-vibration characteristics and a heat radiation effect, weight reduction, and lower cost.

Although the present embodiment is explained in the context of a structure which has a projection 2D, the invention can be adaptable to a structure which does not have a projection 2D.

Figure 4A:
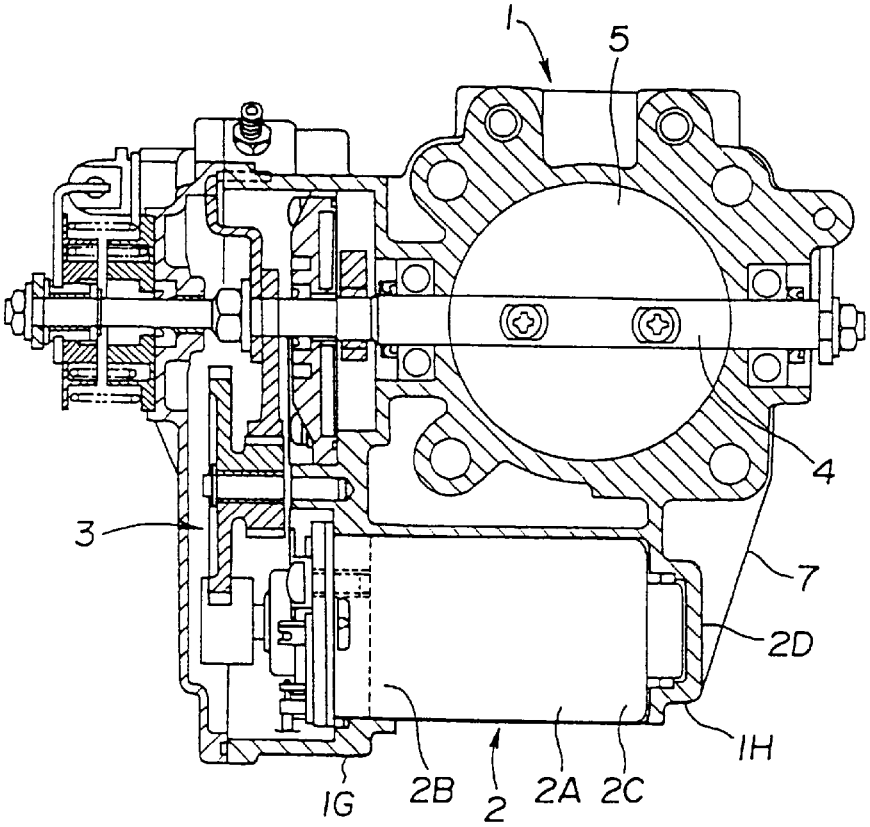
FIG. 4A is a section view of an apparatus for controlling a throttle valve electronically according to the present invention which improves a strength of a bracket 1H.
Figure 4B:
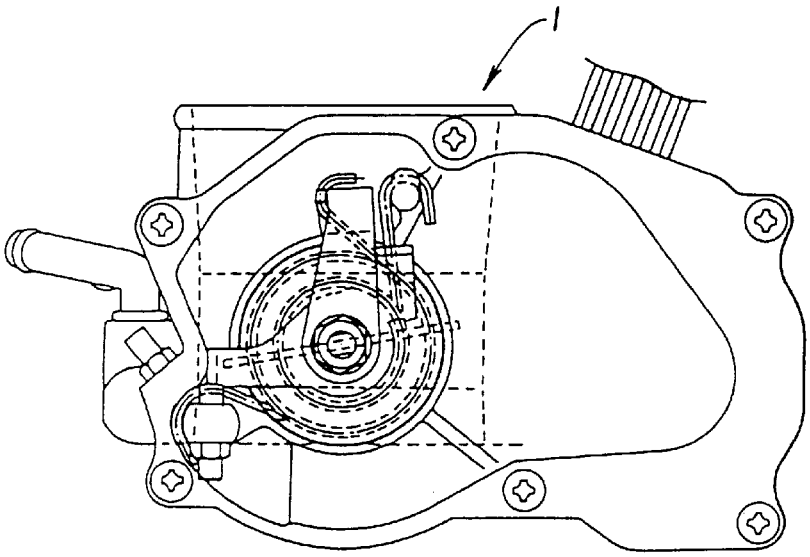
FIG. 4B is a side view of an apparatus for controlling a throttle valve electronically according to the present invention which improves the strength of a bracket 1H.
Figure 5A:
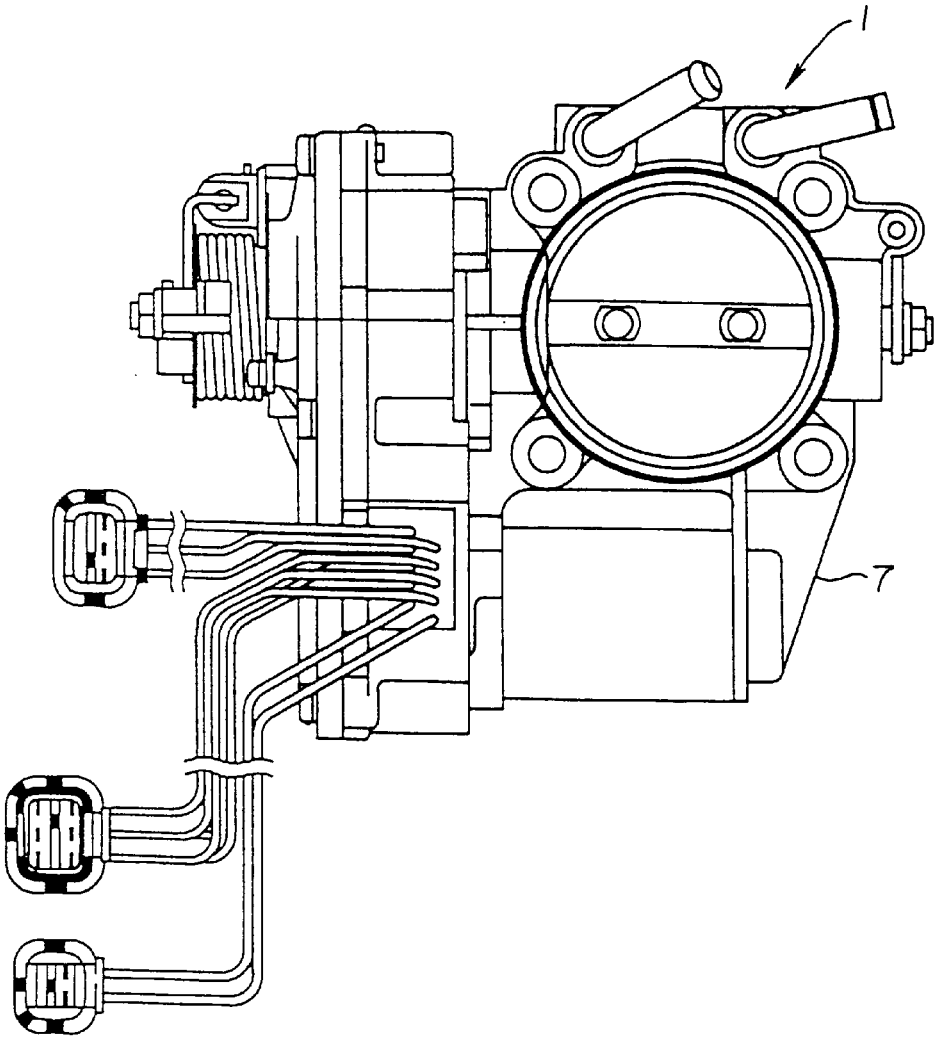
FIG. 5A is a plan view of an apparatus for controlling a throttle valve electronically according to the present invention which improves the strength of a bracket 1H.
Figure 5B:
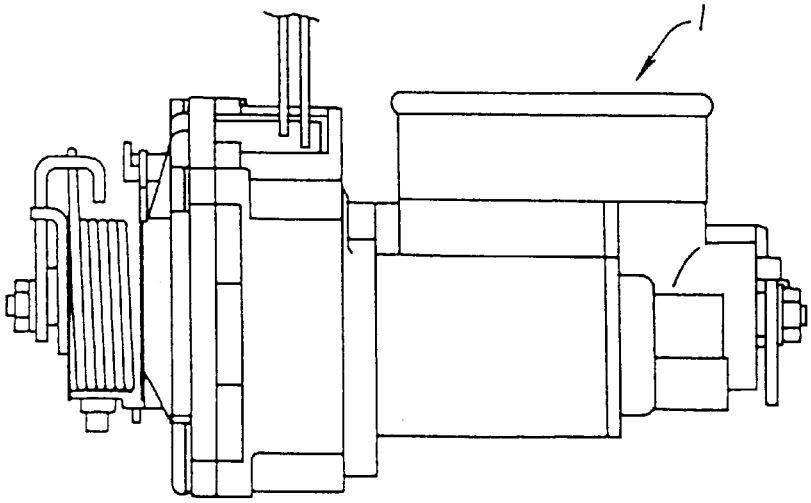
FIG. 5B is a front view of an apparatus for controlling a throttle valve electronically according to the present invention which improves the strength of a bracket 1H.
Figure 6:
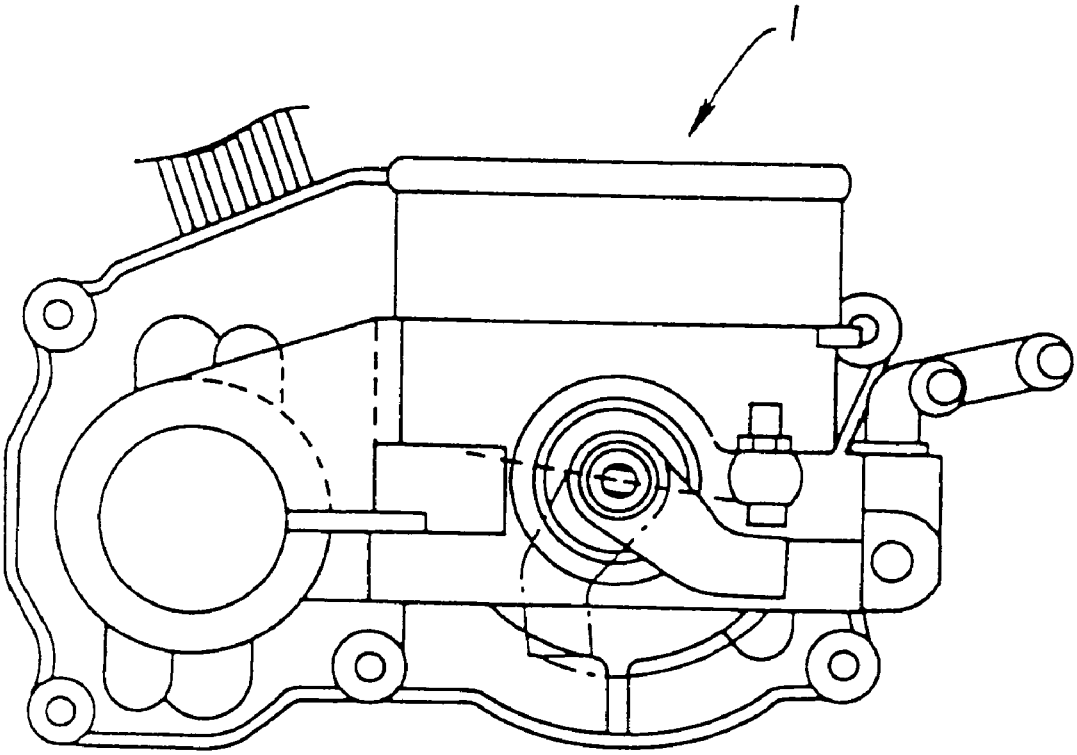
FIG. 6 is a side view of an apparatus for controlling a throttle valve electronically according to the present invention which improves a strength of a bracket 1H.

In addition, a rib 7 for the bracket 1H which extends at least to the rotational axis side of the actuator, can be added to improve the strength of the bracket 1H as shown in FIGS. 4,5,6.

The entire contents of Japanese Patent Application No. TOKUGANHEI 9-065857, filed Mar. 19, 1997 is incorporated herein by reference.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An apparatus for controlling a throttle valve electronically in an internal combustion engine, comprising:

a) a throttle valve with a rotation axis disposed in an intake air passage of an internal combustion engine;

b) an actuator with two ends and a central body disposed in parallel with said rotation axis of said throttle valve; and c) a casing formed around said throttle valve and said actuator, but not covering said central body of said actuator to thereby allow a mold for said casing to be slidably removed in a direction at approximately a right angle to said rotation axis.

2. An apparatus as defined in claim 1, wherein said molded casing includes a plurality of supporting structures, with a different supporting structure disposed at each of the two ends of said actuator in order to hold said actuator.

3. An apparatus as defined in claim 2, further comprising a plurality of seal members, with a different seal member fixed between each of said supporting structures and said actuator.

4. An apparatus as defined in claim 3, wherein said seal members comprise o-rings.

5. An apparatus as defined in claim 2, wherein said actuator has an output end and a non-output end, and wherein one of said supporting structures disposed at said non-output end comprises a bracket with a rib that extends at least to a rotational axis of said actuator.

6. A method for forming a casing for an electronically controlled throttle valve, comprising the steps of:

a) disposing a mold around a throttle valve that has an intake air passage with a central rotation axis, and around an actuator that is positioned adjacent to and in parallel with said throttle valve;

b) forming a casing around said throttle valve and actuator with the mold; and c) removing said mold in a direction at approximately a right angle to said central rotation axis of said intake air passage.

7. An apparatus for controlling a throttle valve electronically in an internal combustion engine, comprising:

a) open/close means with a rotation axis disposed in an intake air passage of an internal combustion engine;

b) actuator means with two ends and a central body disposed in parallel with said rotation axis of said open/close means; and c) casing means formed around said open/close means and said actuator means, but not covering said central body of said actuator means to thereby allow a mold for said casing to be slidably removed in a direction at approximately a right angle to said rotation axis.

8. An apparatus as defined in claim 7, wherein said casing means includes a plurality of supporting means, with a different supporting means disposed at each of the two ends of said actuator means in order to hold said actuator means.

9. An apparatus as defined in claim 8, further comprising a plurality of seal means, with a different seal means fixed between each of said supporting means and said actuator means.

10. An apparatus as defined in claim 9, wherein said seal means comprise o-rings.

11. An apparatus as defined in claim 8, wherein said actuator means has an output end and a non-output end, and wherein said supporting means disposed at said non-output end comprises a bracket with a rib that extends to a rotational axis of said actuator means.

* * * * *